US008540143B2

(12) United States Patent
Cha et al.

(10) Patent No.: US 8,540,143 B2
(45) Date of Patent: Sep. 24, 2013

(54) CASSETTE FOR AUTOMATED TELLER MACHINE

(75) Inventors: Jin Hwan Cha, Seoul (KR); Won Joon Lee, Seoul (KR); Dong Sik Lee, Seoul (KR)

(73) Assignee: Nautilus Hyosung Inc., Seoul (KR)

( * ) Notice: Subject to any disclaimer, the term of this patent is extended or adjusted under 35 U.S.C. 154(b) by 0 days.

(21) Appl. No.: 13/581,267

(22) PCT Filed: Feb. 28, 2011

(86) PCT No.: PCT/KR2011/001380

§ 371 (c)(1),
(2), (4) Date: Aug. 24, 2012

(87) PCT Pub. No.: WO2011/105868

PCT Pub. Date: Sep. 1, 2011

(65) Prior Publication Data

US 2012/0312835 A1 Dec. 13, 2012

(30) Foreign Application Priority Data

Feb. 26, 2010 (KR) ..... 10-2010-0017696

(51) Int. Cl.

| | |
|---|---|
| ***G06Q 40/00*** | (2012.01) |
| ***A47G 29/12*** | (2006.01) |
| ***B65H 5/22*** | (2006.01) |

(52) U.S. Cl.
USPC ..... 235/379; 232/43.1; 232/43.3; 271/3.14

(58) Field of Classification Search
USPC ..... 235/379; 232/43.1, 43.3; 271/3.14
See application file for complete search history.

(56) References Cited

U.S. PATENT DOCUMENTS

| | | | | |
|---|---|---|---|---|
| 4,275,667 | A * | 6/1981 | Hilton | 109/44 |
| 4,529,118 | A * | 7/1985 | Granzow et al. | 232/43.3 |
| 7,520,501 | B2 | 4/2009 | Lee | |
| 2005/0140079 | A1 | 6/2005 | Lee | |
| 2006/0017211 | A1 * | 1/2006 | Yanagida | 271/3.14 |

FOREIGN PATENT DOCUMENTS

| | | | |
|---|---|---|---|
| KR | 10-2004-0105197 | A | 12/2004 |
| KR | 10-2005-0066382 | A | 6/2005 |
| KR | 20-0392318 | Y1 | 8/2005 |

OTHER PUBLICATIONS

PCT International Search Report, PCT/KR2011/001380, Sep. 27, 2011, 5 Pages.

* cited by examiner

*Primary Examiner* — Thien M Le
*Assistant Examiner* — Claude J Brown
(74) *Attorney, Agent, or Firm* — Fenwick & West LLP

(57) ABSTRACT

A cassette for an automatic teller machine (ATM) is provided, which is capable of returning a paper medium disposed at an entrance of the cassette into the cassette using a moving force of a shutter that closes the entrance, during separation of the cassette from a cassette receiving portion.

10 Claims, 14 Drawing Sheets

CASSETTE FOR AUTOMATED TELLER MACHINE

TECHNICAL FIELD

The present invention relates to a cassette for an automatic teller machine (ATM) and, more particularly, to a cassette for an ATM, which is capable of returning a paper medium disposed at an entrance of the cassette into the cassette, during separation of the cassette from a cassette receiving portion.

BACKGROUND ART

Generally, an automatic teller machine (ATM) refers to an automated apparatus providing fundamental monetary services, such as payment and withdrawal of cash and check, using a card or a bankbook regardless of time and places without a bank teller. Recently, use of the ATM is not limited to banking facilities such as banks but expanded to convenience stores, department stores, and other public places.

The ATM may be classified into a cash dispenser, a cash receiver, and a cash dispenser and receiver. In these days, the ATM is used for not only payment and withdrawal of cash but also payment and withdrawal of check, bankbook arrangement, fee payment by giro, ticketing, and the like.

Inside the ATM, a transfer path is formed for transfer of a paper medium such as cash, checks, tickets, merchandise coupons, and the like. In addition, the ATM may include a cassette receiving portion to removably receive a cassette. The cassette is adapted to receive a paper medium to be dispensed to a customer or a paper medium received from a customer. Therefore, by transferring the cassette, the paper medium may be conveniently transferred to the outside of the ATM. Also, the paper medium in the ATM may be conveniently changed by replacing the cassette.

When the cassette is connected to the cassette receiving portion, an end of the transfer path is disposed at an entrance. Therefore, the paper medium in the cassette may be introduced to the end of the transfer path through the entrance and dispensed to a dispenser portion through the transfer path. In addition, the paper medium transferred along the transfer path may be stored in the cassette through the entrance.

However, when the cassette used for dispensing the paper medium is separated, the paper medium may remain at the entrance of the cassette being separated. Therefore, the paper medium may be partially exposed through the entrance of the cassette separated from the cassette receiving portion. Furthermore, when the cassette is connected again to the cassette receiving portion, the paper medium remaining at the entrance may cause a jam.

DISCLOSURE OF INVENTION

Technical Goals

An aspect of the present invention provides a cassette of an automatic teller machine (ATM), the cassette capable of returning a paper medium abnormally disposed at an entrance of the cassette at the time of separating the cassette into the cassette in advance, thereby increasing security and reliability in use of the cassette, and also capable of preventing a jam of the paper medium disposed at the entrance at the time of connecting the cassette.

Another aspect of the present invention provides a cassette of an ATM, the cassette capable of easily returning a paper medium disposed at an entrance using a moving force of a shutter that opens and closes the entrance during connection and separation of the cassette, and simplifying a structure for returning of the paper medium.

Technical Solutions

According to an aspect of the present invention, there is provided a cassette for an automatic teller machine (ATM), the cassette removably connected to a cassette receiving portion formed at a main body of the ATM.

The cassette may include a cassette body connected and separated with respect to the cassette receiving portion and configured to receive a paper medium, including an entrance disposed at one side for entry of the paper medium, a shutter movably formed at the cassette body to open and close the entrance according to connection and separation of the cassette body with respect to the cassette receiving portion, a first medium support portion movably formed in the cassette body to push the paper medium toward the entrance, a second medium support portion movably formed at the entrance so that the paper medium is disposed between the first medium support portion and the second medium support portion, a connection portion connected to each of opposite ends of the second medium support portion and movably connected at opposite lateral sides of the cassette body, and a medium return gear portion rotatably formed at each of the opposite lateral sides of the cassette body so as to be connected to a connection portion gear connected to the connection portion and to a shutter gear formed at the shutter, the medium return gear portion configured to forcibly move the connection portion in a first direction away from the entrance by a moving force of the shutter when the entrance is closed.

That is, when the cassette is separated, the second medium support portion may be forcibly moved in the first direction using the moving force of the shutter moving in the direction for closing the entrance. Accordingly, the paper medium disposed at the entrance may be return into the cassette body by the second medium support portion. Therefore, the paper medium may be prevented from being abnormally disposed at the entrance of the cassette separated from the cassette receiving portion.

The opposite ends of the second medium support portion may include connection holes or connection grooves in which connection projections formed at the portion portion are movably inserted. The connection holes or the connection grooves may extend in a movement direction of the second medium support portion to be longer than a movement distance of the second medium support portion. The second medium support portion and the cassette body may include a return spring to provide an elastic force in a second direction toward an initial position of the second medium support portion.

Therefore, when the connection portion is moved in the first direction, the connection projections may be caught in the connection holes or connection grooves, thereby moving the second medium support portion in the first direction. When the connection portion is moved in the second direction, the connection projections are released. Therefore, the second medium support portion may be moved in the second direction by the return spring.

The cassette may further include a locking portion disposed at each of the opposite lateral sides of the cassette body, respectively, to restrict movement of the second medium support portion until the first medium support portion is operated when the connection portion is moved in the second direction. That is, although the connection portion is moved in the second direction by the medium return gear portion, the second medium support portion may be maintained in a state of being prevented from moving by the locking portion until the first medium support portion is operated. Therefore, when the cassette is connected, the paper medium may be stably supported by the first medium support portion and the second medium support portion.

Here, the opposite ends of the second medium support portion may include a locking hole or locking recess. The locking portion may include a locking projection movably formed at the cassette body to be inserted in the locking hole or locking recess when the second medium support portion is moved in the first direction and separated from the locking hole or locking recess when the second medium support portion is moved in the second direction, and an elastic member disposed between the locking projection and the cassette body to elastically support the locking projection.

Therefore, only when the first medium support portion applies a pressure greater than an elastic force of the elastic member to the paper medium, the locking state of the second medium support portion may be overcome. Next, the second medium support portion may return to an initial position by the elastic force of the return spring.

The shutter gear may be extended by a predetermined length at each of the opposite lateral sides of the shutter to move the connection portion by a predetermined distance in the first direction at the beginning of closing the entrance or to move the connection portion by a predetermined distance in the second direction right before the entrance is fully opened. That is, the shutter gear may extend along the movement direction of the shutter at the opposite lateral sides of the shutter corresponding to the medium return gear portion. The shutter gear may be extended by a predetermine length so that the second medium support portion is moved at a particular point of time. The particular point of time may include at the beginning of closing the entrance and right before the entrance is fully opened. At the particular point of time, returning of the paper medium by the second medium support portion may be more efficiently performed. Also, the paper medium may be more stably supported by the second medium support portion and the first medium support portion.

The shutter may include a first stopper disposed at each opposite sides to the opposite lateral sides of the shutter and extended in a movement direction of the shutter. The medium return gear portion may include a second stopper disposed at one side of the medium return gear portion to be brought into contact with the first stopper in a sliding manner so as to restrict rotation of the medium return gear portion when the shutter gear and the medium return gear portion are not connected. Therefore, the medium return gear portion may be rotated only when connected to the shutter gear but may be stopped by the first stopper and the second stopper in the other states.

The opposite lateral sides of the cassette body may each include a pressed portion pressed by a predetermined depth by interference with an interference portion formed at the cassette receiving portion when the cassette is connected. The pressed portion may include a pressed portion gear disposed at one side of the pressed portion to restrict rotation of the medium return gear portion through connection with the medium return gear portion. Connection between the medium return gear portion and the pressed portion gear may be released when the pressed portion is pressed by the predetermined depth. The pressed portion may be interfered with the interference portion before the medium return gear portion and the shutter gear are connected when the cassette is connected, and interference between the pressed portion and the interference portion may be released after the medium return gear portion and the shutter gear are connected when the cassette is separated.

Therefore, since the restricted state of the pressed portion gear and the medium return gear portion is released only when the cassette is connected in the cassette receiving portion including the interference portion, undesired opening of the entrance may be prevented. Accordingly, security and stability of the cassette may be increased.

The second medium support portion may include a support portion body movably disposed in the cassette body, opposite ends of which are extended along the opposite lateral sides of the cassette body, a plurality of support projections protruded from the support portion body toward the entrance and brought into contact with the paper medium when the connection portion is returned in the first direction, and a rubber pad removably connected by enclosing an outer circumference of the support projections to increase a contact force between the support projections and the paper medium. Accordingly, since a contact force between the second medium support portion and the paper medium is increased by the rubber pad, returning efficiency of the paper medium by the second medium support portion may be increased.

The rubber pad may include an upper fitting portion formed in a ring shape to be fit with an upper fixing recess formed at an upper portion of each of the support projection, a lower fitting portion formed in a ring shape to be fit with a lower fixing recess of each of the support projections, and a contact portion connected to the upper fitting portion and the lower fitting portion and disposed at a contact surface of the support projections contacting the paper medium. Therefore, the rubber pad may be simply connected and separated by the support projection. Accordingly, cost and time for maintenance of the rubber pad may be reduced.

Effects of Invention

A cassette for an automatic teller machine (ATM) according to an embodiment of the present invention returns a paper medium disposed at an entrance into a cassette body by a moving force of a shutter that opens and closes the entrance during separation of the cassette. Therefore, during separation of the cassette, exposure of the paper medium out of the cassette through the entrance may be overcome. In addition, a jam caused by the paper medium disposed at the entrance may be prevented. Accordingly, security and reliability in connection and separation of the cassette may be increased.

In addition, the cassette for the ATM according to the embodiment of the present invention has a simple structure in which a medium return gear portion is connected to a shutter gear formed at the shutter and to a connection portion gear of a connection portion connected to a second medium support portion. Therefore, the structure may be applied to various types of cassette and reduce an installation space.

The cassette according to the embodiment of the present invention is structured to drive the second medium support portion by the moving force of the shutter that opens and closes the entrance. Therefore, a dedicated power source is not necessary. Consequently, a structure for transmitting and controlling power may be omitted.

Furthermore, the cassette according to an embodiment of the present invention may control an operation time and operation distance simply by switching the medium return gear portion, the shutter gear, and the connection portion gear. Accordingly, the cassette may be conveniently designed according to design conditions and circumstances.

BEST MODE FOR CARRYING OUT THE INVENTION

Figure 1:
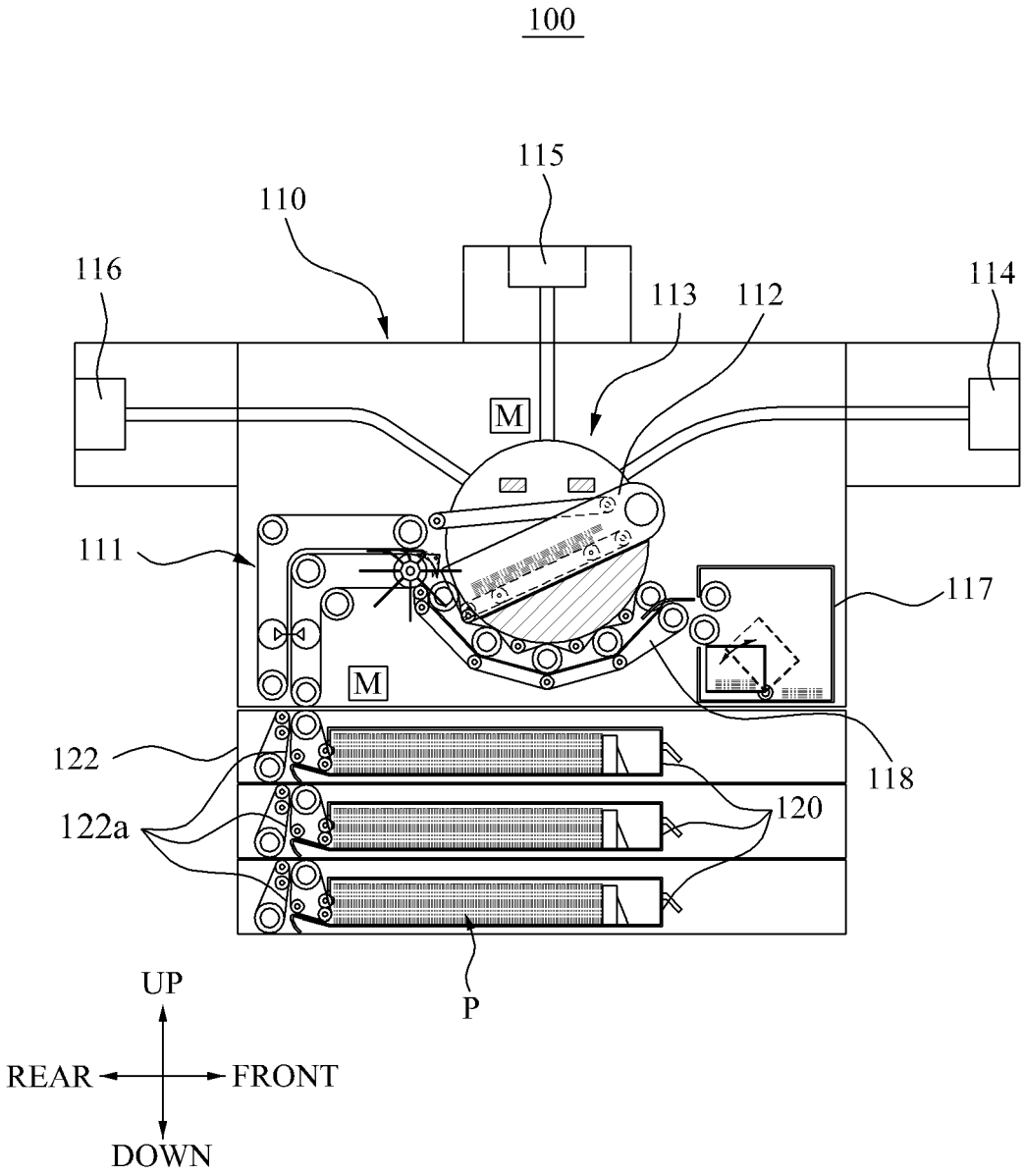
FIG. 1 is a diagram illustrating an automatic teller machine (ATM) according to an embodiment of the present invention.

Reference will now be made in detail to embodiments of the present invention, examples of which are illustrated in the accompanying drawings, wherein like reference numerals refer to the like elements throughout. The embodiments are described below in order to explain the present invention by referring to the figures.

FIG. 1 is a diagram illustrating an automatic teller machine (ATM) 100 according to an embodiment of the present invention.

Referring to FIG. 1, the ATM 100 may include a main body 110 and a cassette 120. For a convenient explanation, the ATM 100 will be described as functioning as only a dispenser of a paper medium P. However, the embodiment is also applicable to an ATM 100 performing a receiving function or a receiving and dispensing function of a paper medium P. The paper medium P may include banknotes, checks, merchandise coupons, bills, coupons, and the like. However, hereinafter, the paper medium P will be described as banknotes.

The main body 110 may include a medium transfer portion 111, a carriage 112, a rotor 113, dispenser portions 114, 115, and 116, a reject box 117, and a reject transfer portion 118.

The medium transfer portion 111 may transfer the paper medium P supplied from the cassette 120 and temporarily stack the paper medium P in the carriage 112. The carriage 112 may dispense the paper medium P transferred by the medium transfer portion 111 through the dispenser portions 114, 115, and 116 in a bundle. The rotor 113 may be rotated along with the carriage 112 so that the carriage 112 is moved to any one of the dispenser portions 114, 115, and 116. The reject box 117 may store a paper medium including at least two sheets or a skewed paper medium. By the reject transfer portion 118, the paper medium including at least two sheets or the skewed paper medium may be guided directly to the reject box 117, without passing through the carriage 112 and the rotor 113.

Figure 2:
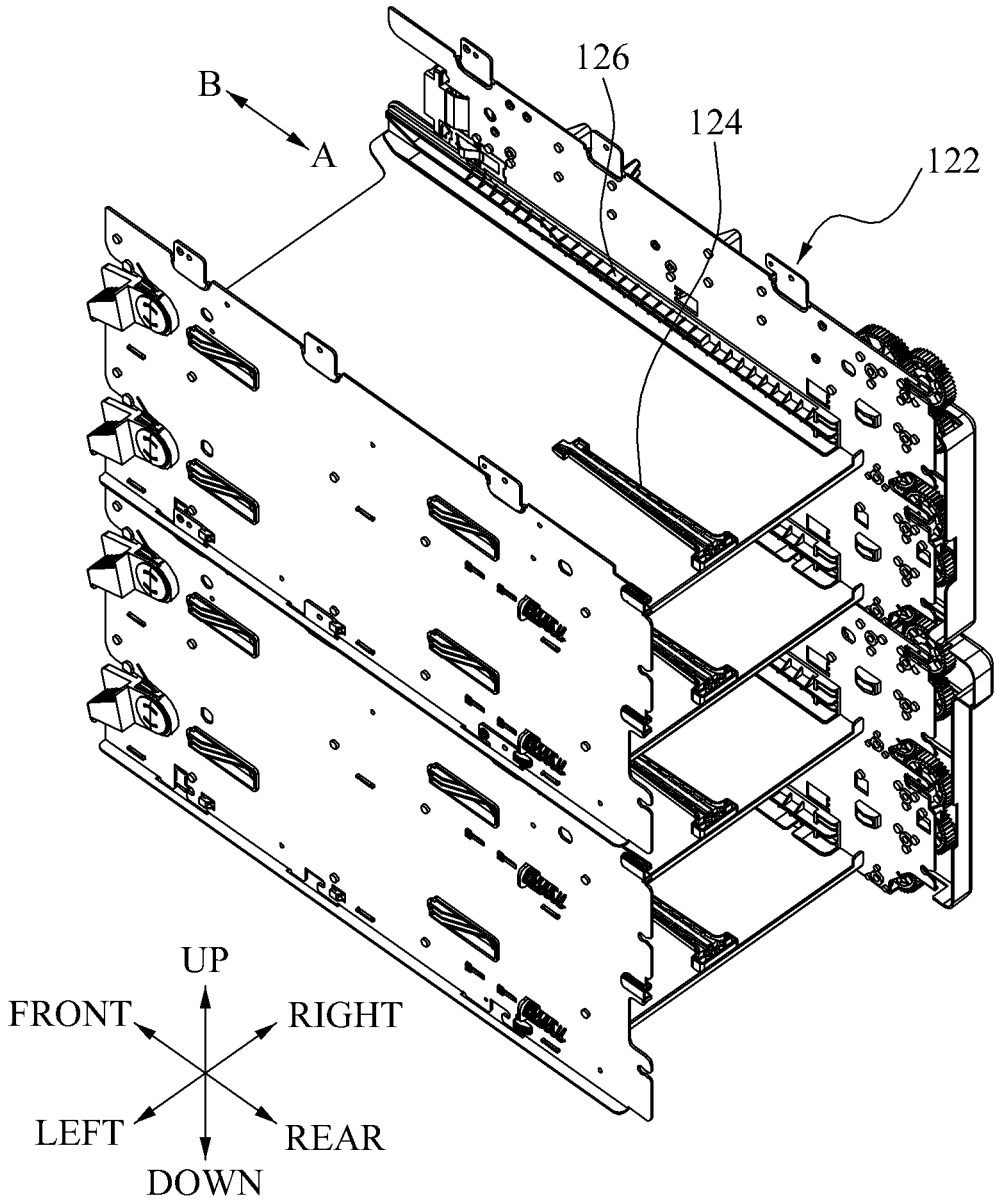
FIG. 2 is a perspective view illustrating a cassette receiving portion of the ATM shown in FIG. 1.
Figure 3:
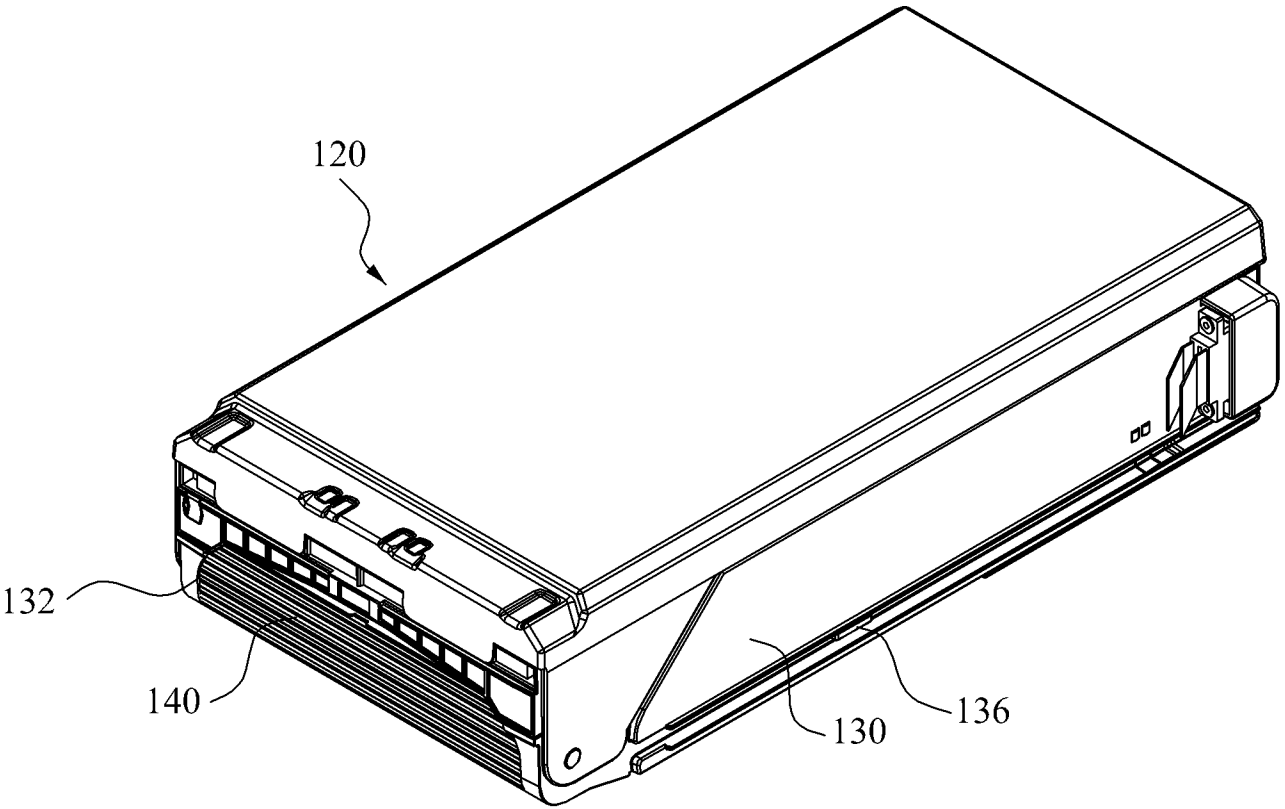
FIG. 3 is a perspective view illustrating a cassette of the ATM shown in FIG. 1.
Figure 4:
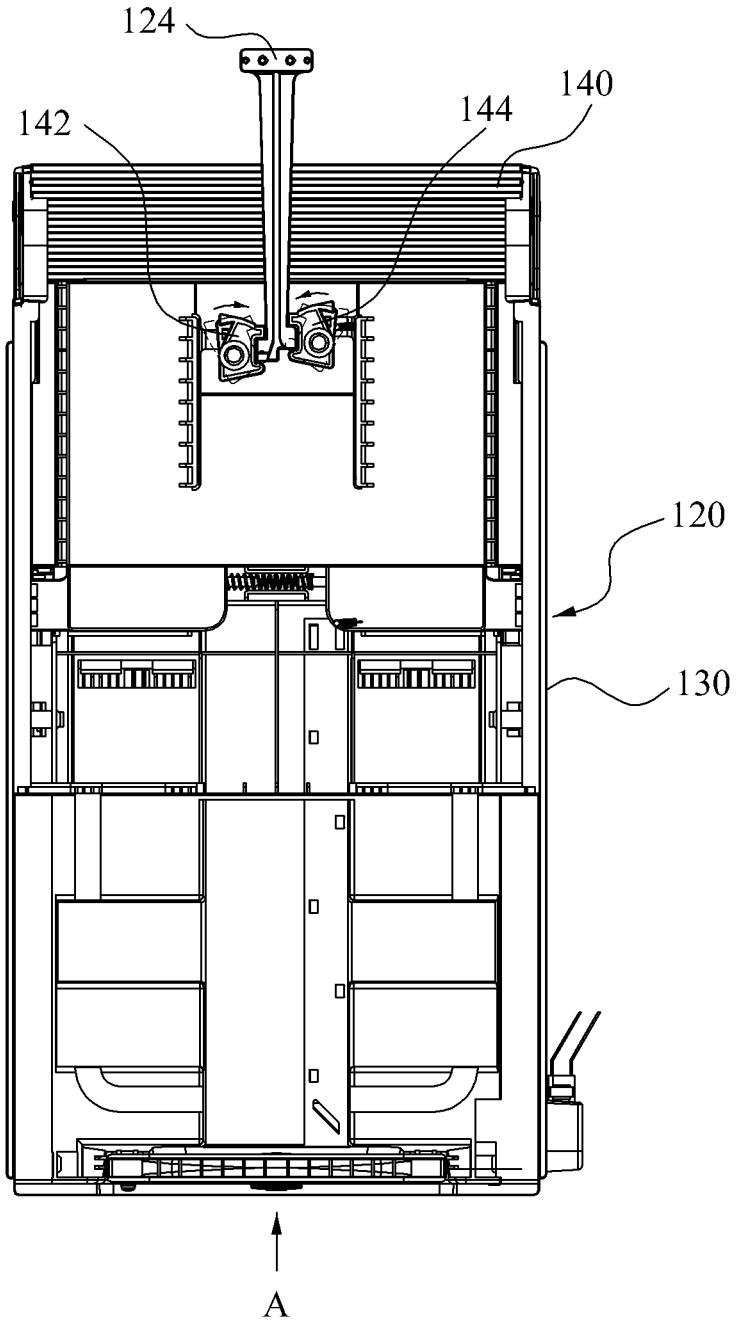
FIGS. 4 and 5 are state views illustrating operation of a shutter during connection and separation of the cassette.
Figure 5:
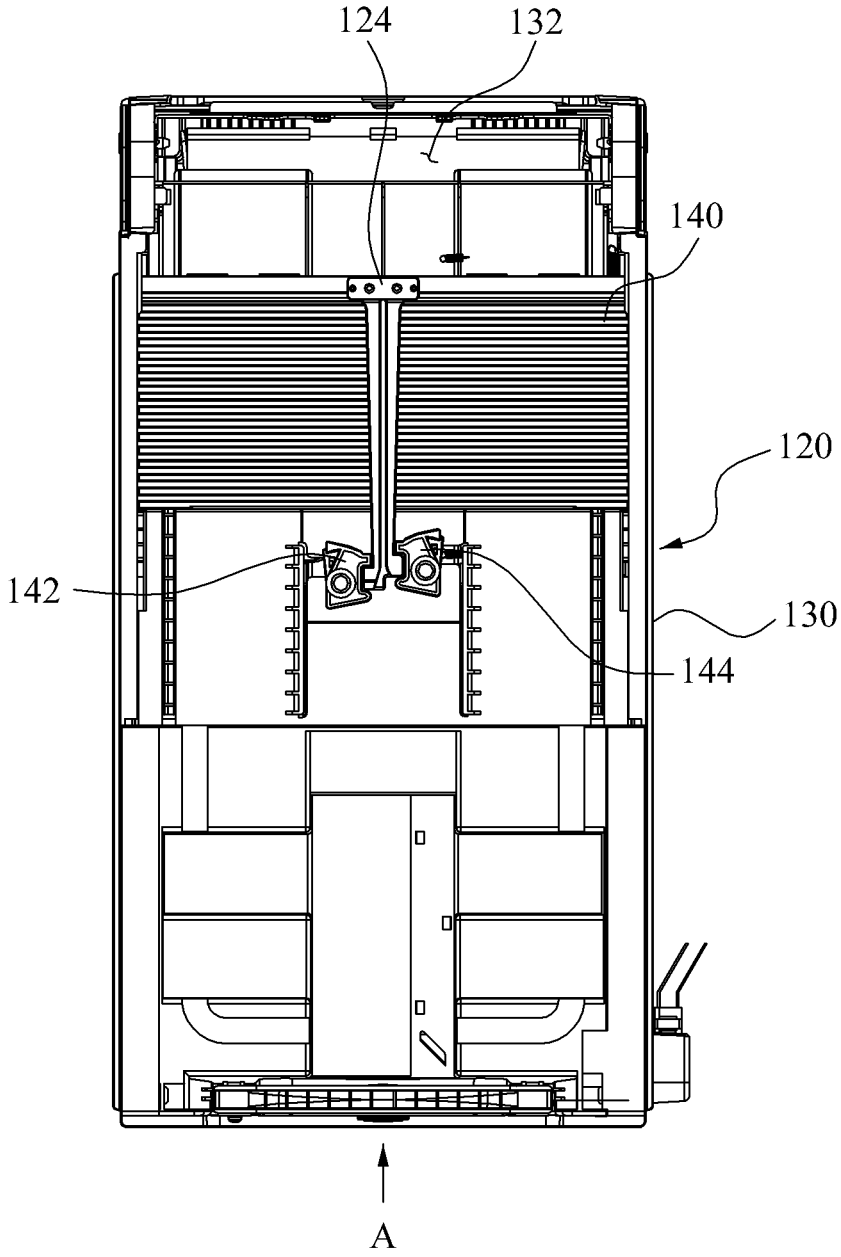

FIG. 2 is a perspective view illustrating a cassette receiving portion 122 of the ATM 100 shown in FIG. 1. FIG. 3 is a perspective view illustrating the cassette 120 of the ATM 100 shown in FIG. 1. FIGS. 4 and 5 are state views illustrating operation of a shutter 40 during connection and separation of the cassette 120.

Referring to FIGS. 1 to 3, the cassette 120 may be connected in an arrowed direction A and separated in an arrowed direction B with respect to the cassette receiving portion 122 disposed at the main body 110. The cassette receiving portion 122 may be disposed at a lower portion of the main body 110. The cassette receiving portion 122 may include a plurality of receiving spaces for receiving a plurality of cassettes 120. The cassette receiving portion 122 may include a medium separation portion 122*a* to separate the paper medium P received in the cassette 120 into individual sheets and transfer the separated paper medium P to the medium transfer portion 111.

The cassette 120 may include a cassette body 130, a shutter 140, a first medium support portion 150, a second medium support portion 160, a connection portion 170, a medium return gear portion 180, and a locking portion 190.

The cassette body 130 may be removably received in a receiving space of the cassette receiving portion 122. The paper medium P may be received in the cassette body 130. An entrance 132 through which the paper medium P comes in and out may be formed at a front side of the cassette body 130. Here, when the cassette 120 is inserted in the arrowed direction A for connection to the cassette receiving portion 130, the medium separation portion 122*a* is inserted in the entrance 132 and brought into close contact with the medium P received in the cassette body 130.

The shutter 140 may be movably formed at the cassette body 130 to open and close the entrance 132. The shutter 140 may open the entrance 132 as the cassette body 130 is received in the direction A. Since the shutter 140 is opened in advance by the cassette body 130 being received in the cassette receiving portion 122, the medium separation portion 122*a* being inserted in the entrance 132 may not be interfered with the shutter 140.

When the cassette body 130 is separated from the cassette receiving portion 122 in the direction B, the shutter 140 may be moved in a direction for closing the entrance 132. The shutter 140 may slide along a front side and a lower side of the cassette 120. However, the entrance 132 and the shutter 140 may be disposed in various other positions of the cassette body 130 depending on design conditions and circumstances. Also, a shape and an opening and closing system of the shutter 140 may be varied.

Referring to FIGS. 2, 4, and 5, the shutter 140 may include shutter stoppers 142 and 144. The cassette receiving portion 122 may include a shutter operation lever 124 caught by the shutter stoppers 142 and 144 when the paper medium 120 is connected in the direction A and separated in the direction B. That is, when the cassette 120 is connected to the cassette receiving portion 122 in the direction A, the shutter operation lever 124 may be caught by the shutter stoppers 142 and 144. The shutter stoppers 142 and 144 and the shutter 140 may be relatively moved together in a direction for opening the entrance 132. When the cassette 120 is separated from the cassette receiving portion 122 in the direction B, the shutter stoppers 142 and 144 and the shutter operation lever 124 in engagement with each other may relatively move in a direction for closing the entrance 132. When the entrance 132 is closed by the shutter 140, the shutter operation lever 124 may be separated from the shutter stoppers 142 and 144.

The shutter operation lever 124 and the shutter stoppers 142 and 144 may be in various structures and shapes depending on the design conditions and circumstances of the cassette 120. Hereinafter, according to the present embodiment, the shutter 140 will be described to be opened and closed with respect to the cassette 120. However, alternatively, the cassette body 130 may be moved with respect to the main body 110 with the shutter 140 in a fixed position.

FIGS. 6 through 13 are state views illustrating operation of a second medium support portion 160, a connection portion 170, and a medium return gear portion 180 of when a cassette 120 is connected and separated, according to an embodiment of the present invention. FIG. 14 is a perspective view illustrating main parts of the cassette 120 shown in FIGS. 6 through 13. In FIGS. 6 through 13, a cover disposed at an outside is omitted for inspection of operational states of main parts of when the cassette 120 is connected and separated.

Referring to FIGS. 6 through 14, the first medium support portion 150, which is a member for pushing the paper medium P in the cassette body 130 toward the entrance 132, may be movably formed in the cassette body 130. That is, the first medium support portion 150 may support one end of the paper medium P stored in the cassette body 130. Movement of the first medium support portion 150 may be controlled by a dedicated driving motor (not shown). In FIGS. 6 to 13, the paper medium P is indicated by a dotted line for clear inspection of an inner structure of the cassette 120.

Referring to FIGS. 6 through 14, the second medium support portion 160, which is a member for supporting the paper medium P in cooperation with the first medium support portion 150, may be movable by a predetermined distance within the cassette body 130. That is, the second medium support portion 160 may support an opposite end of the medium P stored in the cassette body 130. The second medium support portion 160 may be disposed at the entrance 132 to face the first medium support portion 150. Therefore, the paper medium P may be stably disposed between the first medium support portion 150 and the second medium support portion 160.

In addition, a return spring 134 may be provided at the second medium support portion 160 and the cassette body 130 to provide an elastic force in a second direction D toward an initial position of the second medium support portion 160. Therefore, the second medium support portion 160 may be easily returned to the initial position by the return spring 134.

Referring to FIGS. 6 through 14, the connection portion 170 may be provided at opposite lateral sides of the cassette body 130 to be movable, in connection with opposite ends of the second medium support portion 160. The connection portion 170 may include a connection projection 172.

The connection projection 172 may be movably inserted in connection holes 162*a* or connection grooves formed at the opposite ends of the second medium support portion 160. The connection holes 162*a* or connection grooves may extend in a movement direction of the second medium support portion 160 and, furthermore, longer than a movement distance of the second medium support portion 160. Hereinafter, for a convenient explanation of the present embodiment, the connection holes 162*a* will be described as formed at the opposite ends of the second medium support portion 160, respectively.

Referring to FIGS. 6 through 14, the medium return gear portion 180 refers to a member for forcing the connection portion 170 in a first direction C away from the entrance 132 using a moving force of the shutter 140 at the time of closing the entrance 132. Since the second medium support portion 160 is also forced along with the connection portion 170 in the first direction C, the paper medium P disposed at the entrance 132 may be forced into the cassette body 130. The medium return gear portion 180 may be implemented by pinion gears rotatably formed at the opposite lateral sides of the cassette body 130.

Here, a shutter gear 146 may be provided at each of opposite lateral sides of the shutter 140. The shutter gear 146 is interactively connected to the medium return gear portion 180. The shutter gear 146 may be implemented by a rack gear to convert a linear moving force of the shutter 140 into a rotational force of the second medium support portion 160. The shutter gear 146 may extend along a movement direction of the shutter 140 at a position corresponding to the medium return gear portion 180.

The shutter gear 146 may be formed at each of the opposite lateral sides of the shutter 140 in a predetermined length so as to move the second medium support portion 160 at a particular point of time. That is, the shutter gear 146 may move the connection portion 170 in the first direction C by a predetermined distance at the beginning of closing the entrance 132 or move the connection portion 170 in the second direction D right before the entrance 132 is fully opened. Thus, the particular point of time includes the beginning of closing the entrance 132 and right before the entrance 132 is fully opened. At the particular point of time, returning of the paper medium P by the second medium support portion 160 may be more efficiently performed. Also, the paper medium P may be more stably supported by the second medium support portion 160 and the first medium support portion 150.

The connection portion 170 may include a connection portion gear 174 for interactive connection with the medium return gear portion 180. The connection portion gear 174 may be implemented by a rack gear to convert the rotational force of the medium return gear portion 180 into the linear moving force of the second medium support portion 160. Since the medium return gear portion 180 is connected to the connection portion gear 174 and the shutter gear 146, simultaneously, the linear moving force of the shutter 140 may linearly move the connection portion 170 through the medium return gear portion 180.

Referring to FIGS. 6 through 13, a first stopper 148 may be provided at each of the opposite lateral sides of the shutter 140, being extended in the movement direction of the shutter 140. In addition, a second stopper 182 may be provided at a lateral side of the medium return gear portion 180. The second stopper 182 contacts the first stopper 148 in a sliding manner so as to restrict rotation of the medium return gear portion 180 at a position where the shutter gear 146 and the medium return gear portion 180 are not connected.

That is, at the beginning of closing the entrance 132 or right before the entrance 132 is fully opened, the medium return gear portion 180 and the shutter gear 146 are connected to each other. However, in the other states, since the medium return gear portion 180 and the shutter gear 146 are not connected, the medium return gear portion 180 may abnormally rotate in a random direction. Therefore, the first stopper 148 and the second stopper 182 may be provided to the medium return gear portion 180 and the shutter 140 to prevent the random rotation of the medium return gear portion 180 when the medium return gear portion 180 and the shutter gear 146 are not connected.

Referring to FIGS. 6 to 13, the locking portion 190 temporarily restricts the second medium support portion 160 moved in the first direction C from returning to an initial position. That is, although the second medium support portion 160 is moved in the second direction D by the medium return gear portion 180, the locking portion 190 may temporarily restrict movement of the second medium support portion 160. Therefore, in a state where the cassette 120 is connected to the cassette receiving portion 122, the paper medium P may be stably supported by the first medium support portion 150 and the second medium support portion 160.

The restricted state of the second medium support portion 160 may be maintained until a pressure is applied to the paper medium P in the second direction D by the first medium support portion 150. That is, the locking portion 190 may temporarily restrict the second medium support portion 160 until before the first medium support portion 150 is driven. When the first medium support portion 150 is driven, the locking portion 190 may release the restricted state of the second medium support portion 160.

For example, the locking portion 190 may include locking projections 192 and elastic members 194. Here, any of locking holes 162*b* and locking recesses in which the locking projection 192 is elastically inserted may be formed at opposite ends of the second medium support portion 160. According to the present embodiment, the second medium support portion 160 will be described to include the locking holes 162*b* at the opposite ends.

The locking projections 192 may be formed movably at the opposite lateral sides of the cassette body 130 and inserted in the locking holes 162*b* of the second medium support portion 160 when the cassette 120 is separated. The locking projections 192 are movable in directions for being inserted in and separated from the locking holes 162*b*. Hereinafter, a guide structure 192*a* movably supporting the locking projections 192 may be formed through the opposite lateral sides the cassette body 130. The locking holes 162*b* are disposed to face the locking projections 192 when the cassette 120 is separated.

In detail, during connection and separation of the cassette 120, when the second medium support portion 160 is moved in the first direction C, the locking projections 192 may be inserted in the locking holes 162*b*, thereby restricting movement of the second medium support portion 160. Conversely, when the second medium support portion 160 is moved in the second direction D, the locking projections 192 may be forcibly separated from the locking holes 162*b*, thereby releasing the restricted state of the second medium support portion 160. In addition, at least one of leading ends of the locking projections 192 and circumferential edges of the locking holes 162*b* may have an inclined portion (not shown) for easy insertion and separation between the locking projections 192 and the locking holes 162*b*.

The elastic members 194 may provide a predetermined degree of elastic force to the locking projections 192 in a direction for insertion into the locking holes 162*b*. That is, the elastic members 194 may elastically support the locking projections 192 in the direction for insertion into the locking holes 162*b*.

The elastic members 194 may be provided at the locking projections 192 and the cassette body 130. The elastic members 194 may include a spring or a rubber band. In the present embodiment, the elastic members 194 will be described as springs of which opposite ends are connected to the opposite lateral sides of the cassette body 130. Also, a middle portion of each of the elastic members 194 may be elastically brought into close contact with each of the locking projections 192.

Therefore, although the connection portion 170 is moved in the second direction D, the second medium support portion 160 is prevented from moving in the second direction D due to the elastic force of the elastic member 194. However, when the first medium support portion 150 applies the pressure greater than the elastic force of the elastic member 194 to the paper medium P, the locking state of the second medium support portion 160 may be overcome. When the locking state is overcome by the pressure of the first medium support portion 150, the second medium support portion 160 may return to the initial position by the elastic force of the return spring 134.

Referring to FIGS. 2 to 13, a pressed portion 136 may be provided to each of the opposite lateral sides of the cassette body 130. The pressed portion 136 is pressed by a predetermined depth by interference with an interference portion 126 formed at the cassette receiving portion 122 occurring when the cassette 120 is connected. The interference portion 126 may be formed in a rib shape at each of the opposite lateral sides of the cassette body 130. The pressed portion 136 may be formed at each of the opposite lateral sides of the cassette body 130 to be elastically pressed.

A pressed portion gear 138 may be provided at one side of the pressed portion 136. The pressed portion gear 138 is selectively connected with the medium return gear portion 180. When the medium return gear portion 180 and the pressed portion gear 138 are connected, rotation of the medium return gear portion 180 may be restricted by the pressed portion gear 138. When the pressed portion 136 is pressed by the predetermined depth by the interference with the interference portion 126, connection between the medium return gear portion 180 and the pressed portion gear 138 may be released, accordingly allowing rotation of the medium return gear portion 180.

When the cassette 120 is connected, the pressed portion 136 may be pressed by the interference portion 126 before connection between the medium return gear portion 180 and the shutter gear 146 is achieved. That is, before the medium return gear portion 180 is rotated by the shutter gear 146, the medium return gear portion 180 becomes rotatable by the pressed portion gear 138. In addition, when the cassette 120 is separated, interference between the pressed portion 136 and the interference portion 126 may be released after the connection between the medium return gear portion 180 and the shutter gear 146 is released. That is, when the medium return gear portion 180 is not rotated by the shutter gear 146, rotation of the medium return gear portion 180 may be restricted by the pressed portion gear 138.

The pressed portions 136 provided at the opposite lateral sides of the cassette 120 may be pressed by different depths by the interference portions 126. Therefore, the restricted state between the pressed portion gear 138 and the medium return gear portion 180 is normally released only when the cassette 120 is connected to the cassette receiving portion 122 including the interference portion 126. Accordingly, the entrance 132 of the cassette 120 may be prevented from being randomly opened. As a result, stability and security of the cassette 120 may be increased.

Referring to FIGS. 6 to 14, the second medium support portion 160 may include a support portion body 162, a support projection 164, and a rubber pad 166. The support portion body 162 may be disposed in the cassette body 130 to be movable by a predetermined distance. Opposite ends of the support portion body 162 may be extended along the opposite lateral sides of the cassette body 130. A plurality of the support projections 164 may protrude from the support portion body 162 toward the entrance 132. A pickup roller (not shown) may be inserted in spaces formed among the support projections 164 to pick up the paper medium P present in the cassette body 130 when the cassette 120 is connected. When the connection portion 170 is moved in the first direction, the support projections 164 may be brought into close contact with the paper medium P. The rubber pad 166 may be removably connected by enclosing an outer circumference of the support projections 164, to increase a contact force between the support projections 164 and the paper medium P. Accordingly, the contact force between the second medium support portion 160 and the paper medium P is increased by the rubber pad 166. Therefore, a returning efficiency of the paper medium P by the second medium support portion 160 may be increased.

The rubber pad 166 may include an upper fitting portion 166*a* formed in a ring shape to be fit with an upper fixing recess 164*a* formed at an upper portion of the support projection 164, a lower fitting portion 166*b* formed in a ring shape to be fit with a lower fixing recess 164*b* of the support projection 164, and a contact portion 166*c* connected to the upper fitting portion 166*a* and the lower fitting portion 166*b* and disposed at a contact surface of the support projection 164 contacting the paper medium P. Therefore, the rubber pad 166 may be connected and separated with respect to the support projection 164 in a simple manner, rather than being bonded to the support projection 164. Accordingly, cost and time for maintenance of the rubber pad 166 may be reduced.

Hereinafter, the operation of the cassette 120 of the ATM 100 structured as aforementioned according to the embodiment of the present invention will be described.

When the cassette 120 is connected to the cassette receiving portion 122 of the ATM 100, the shutter operation lever 124 of the cassette receiving portion 122 is caught by the shutter stoppers 142 and 144 of the cassette 120. That is, as shown in FIGS. 4 and 5, when the cassette 120 is connected, the shutter 140 may be relatively moved in a direction for opening the entrance 132 by the shutter stoppers 142 and 144 and the shutter operation lever 124.

In FIGS. 6 to 13, operational directions of the shutter 140, the medium return gear portion 180, the connection portion 170, and the second medium support portion 160 of when the cassette 120 is connected are indicated by solid-line arrows.

Here, the first stopper 148 formed at the shutter 140 may be slid in close contact with the second stopper 182 formed at the medium return gear portion 180 as shown in FIGS. 6 to 9. Therefore, since the second stopper 182 is engaged with the first stopper 148 in the rotational direction of the medium return gear portion 180, rotation of the medium return gear portion 180 is restricted.

Figure 8:
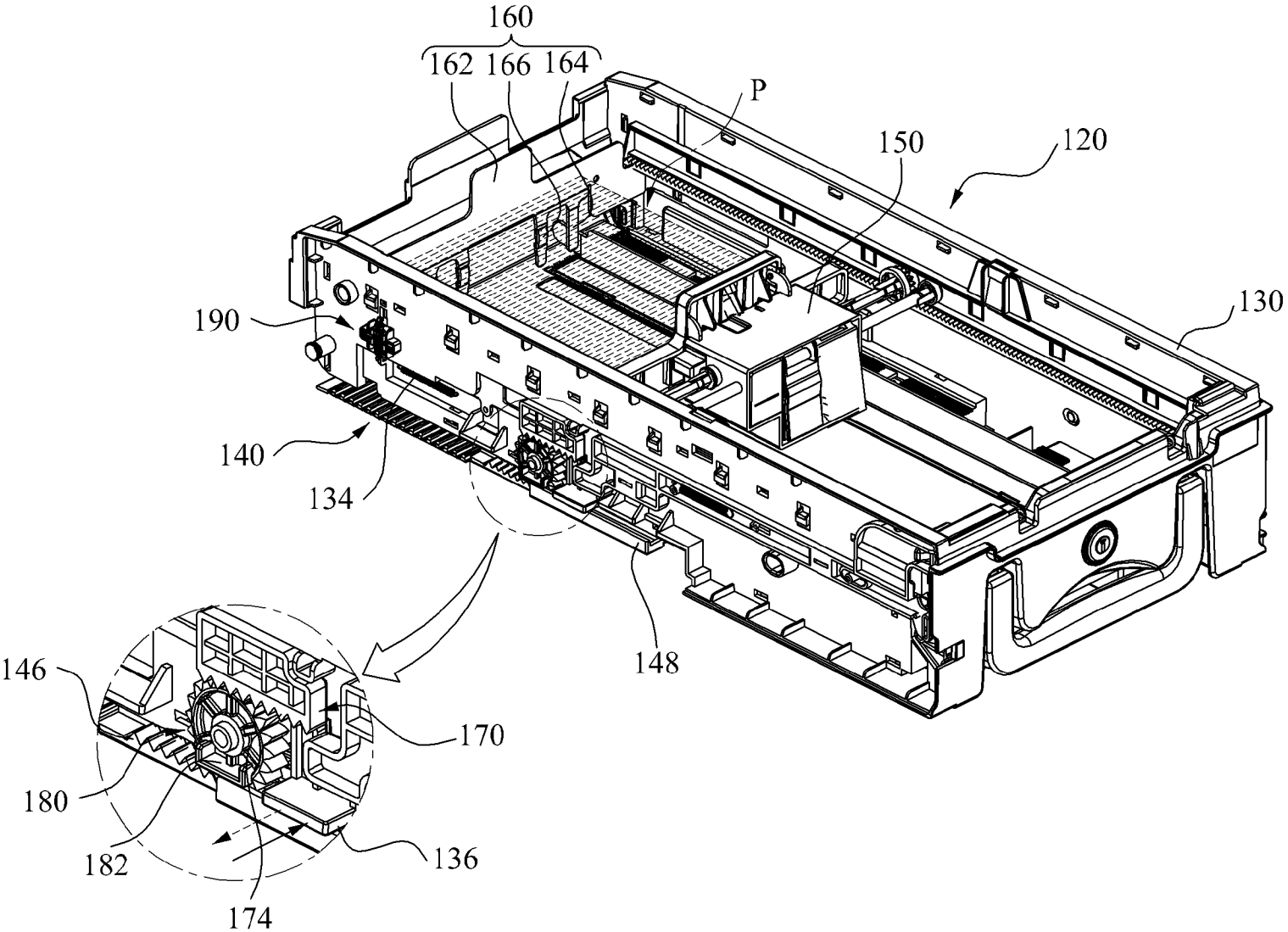
Figure 9:
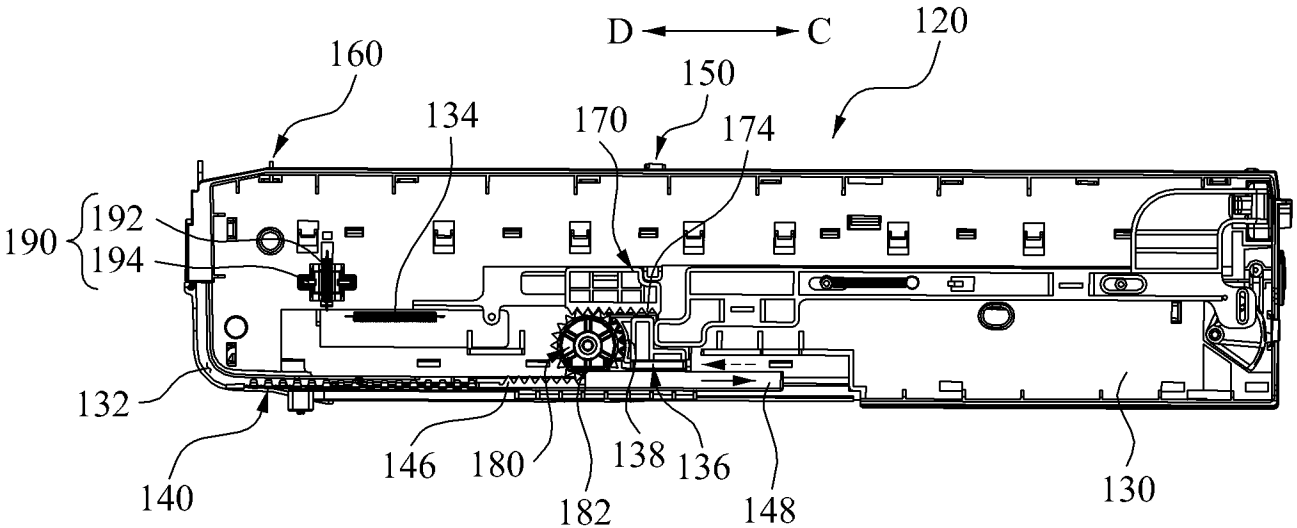

Next, the pressed portion 136 of the cassette 120 is pressed by the predetermined depth by the interference portion 126 formed at the cassette receiving portion 122. As shown in FIGS. 8 and 9, when the pressed portion 136 is pressed by the predetermined depth, connection between the pressed portion gear 138 and the medium return gear portion 180 is released. Therefore, the medium return gear portion 180 may escape from the restricted state with the pressed portion gear 138.

Figure 10:
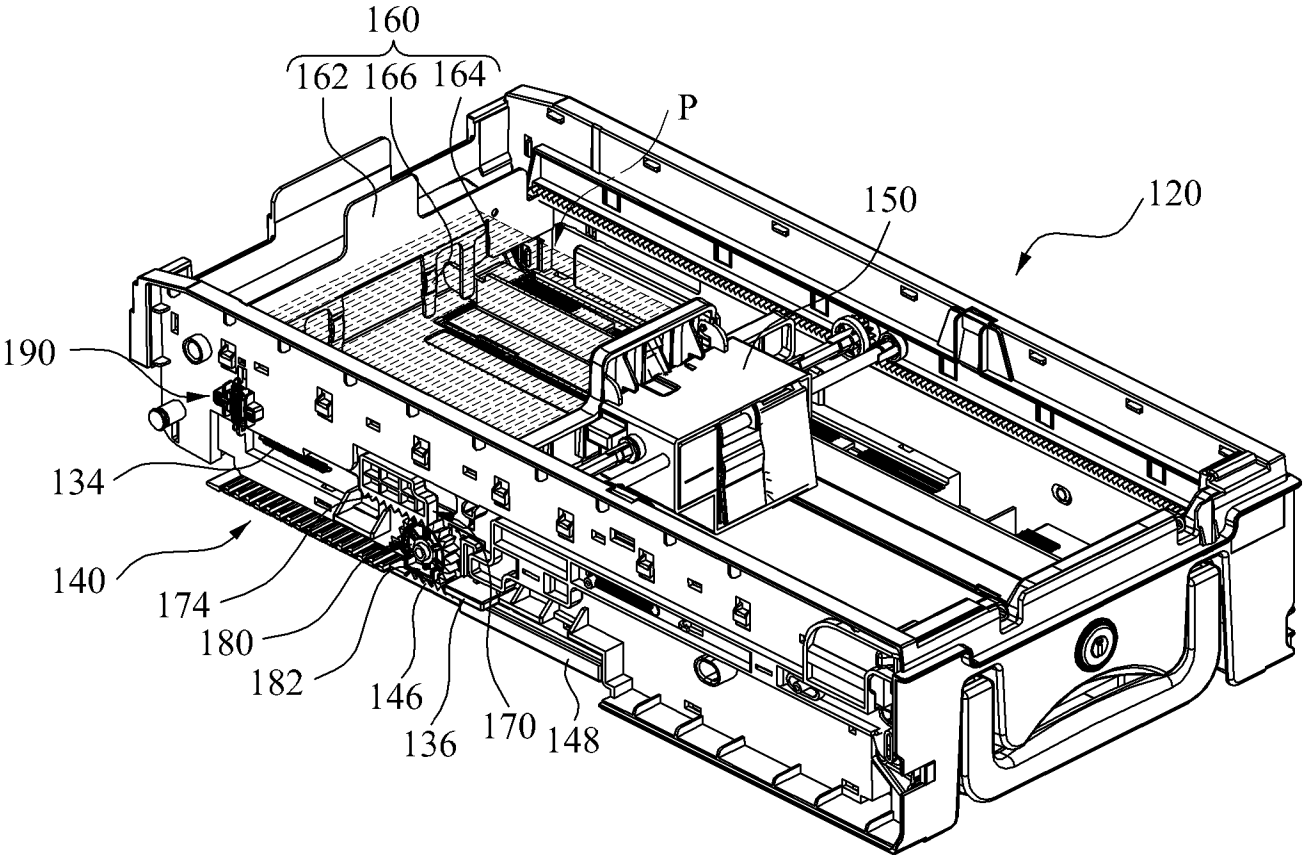
Figure 11:
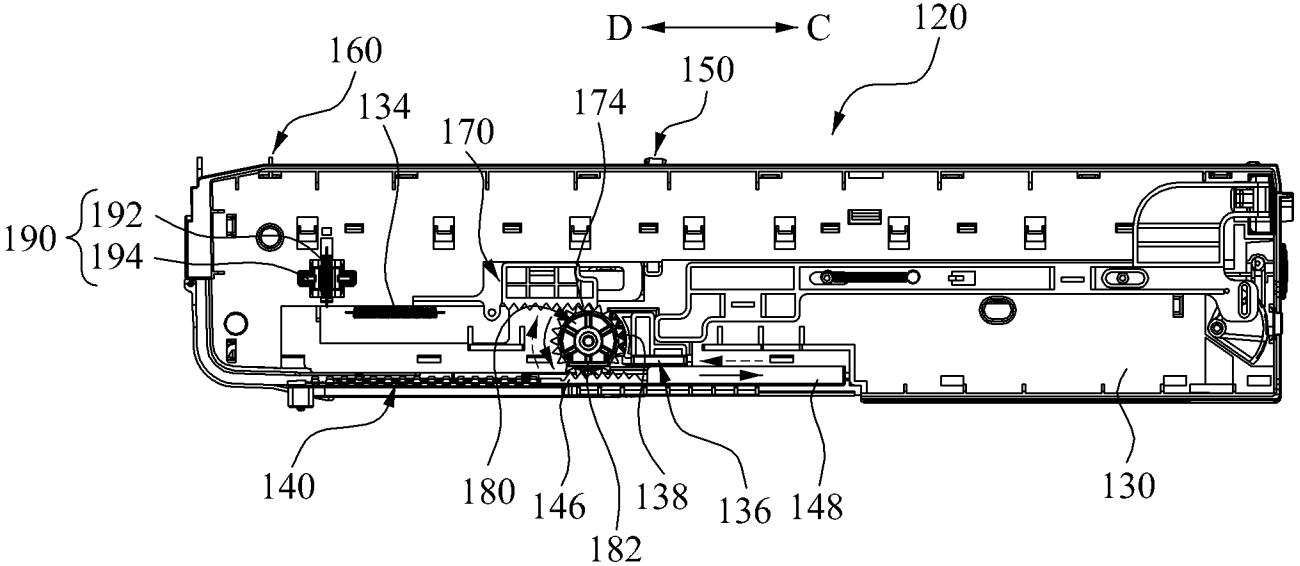

As shown in FIGS. 10 and 11, when the shutter 140 continuously moves in the direction for opening the entrance 132, the first stopper 148 and the second stopper 182 are disposed at positions not to contact each other so that the medium return gear portion 180 becomes rotatable. Here, since the medium return gear portion 180 and the shutter gear 146 are connected to each other, the moving force of the shutter 140 may be transmitted to the medium return gear portion 180.

That is, the linear moving force of the shutter 140 may be transmitted to the medium return gear portion 180 through the shutter gear 146 and converted into the rotational force of the medium return gear portion 180. The rotational force of the medium return gear portion 180 may be converted into the linear moving force of the connection portion 170 through the connection portion gear 174. Therefore, the connection portion 170 may be linearly moved in the second direction D by a predetermined distance corresponding to a length of the shutter gear 146.

In this instance, different from the connection portion 170, the second medium support portion 160 is temporarily restricted from moving by the locking portion 190. Therefore, the second medium support portion 160 is not moved in the second direction D. Since the first medium support portion 150 and the second medium support portion 160 are in close contact with the paper medium P when the cassette 120 is connected, the paper medium P may be stably supported.

When the cassette 120 is connected to the cassette receiving portion 122 completely, the entrance 132 is fully opened and the pickup roller is disposed at the entrance 132 to pick up the paper medium P present in the cassette 120 sheet by sheet. Next, when the first medium support portion 150 moves toward the entrance 132, the pressure of the first medium support portion 150 is applied to the second medium support portion 160 in the second direction D. Accordingly, the second medium support portion 160 may overcome a locking force of the locking portion 190.

Figure 12:
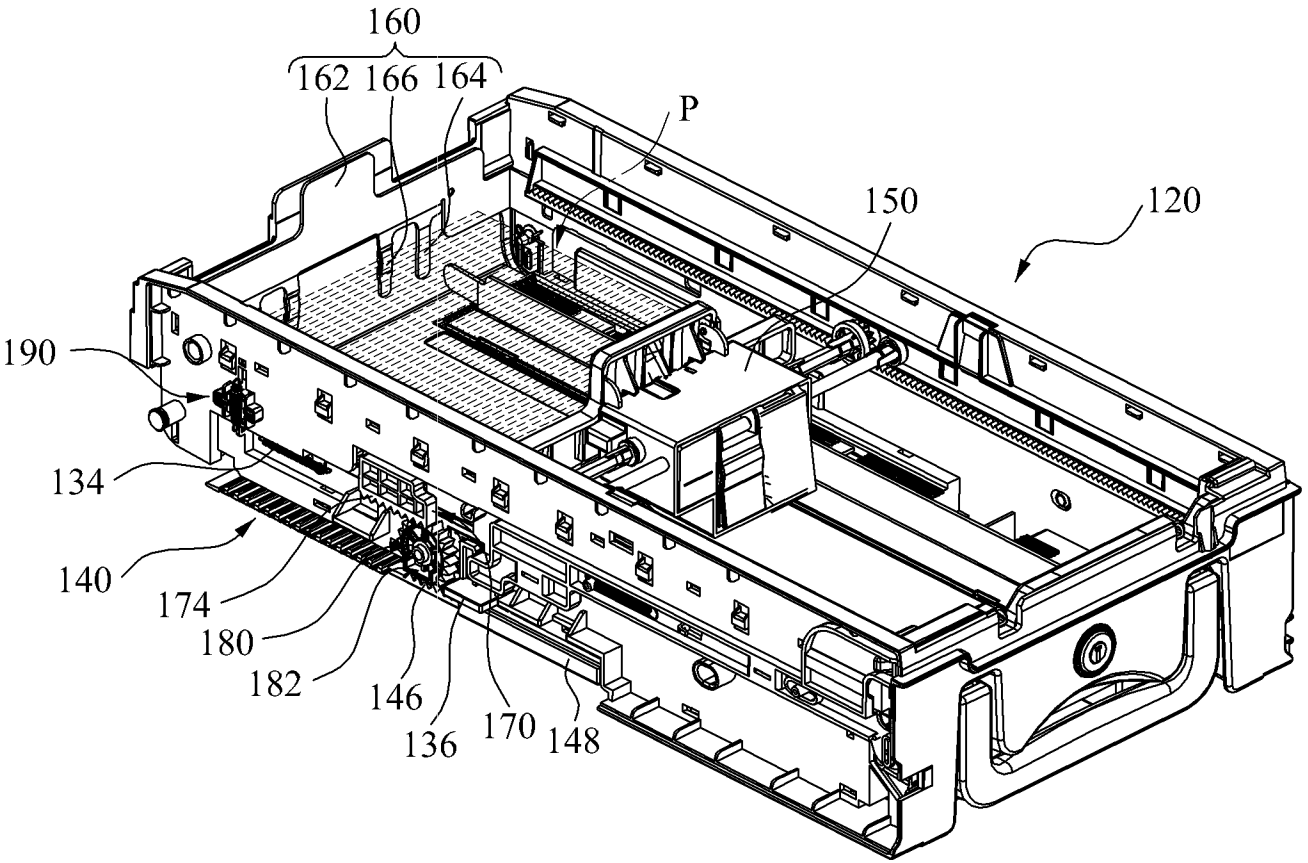
Figure 13:
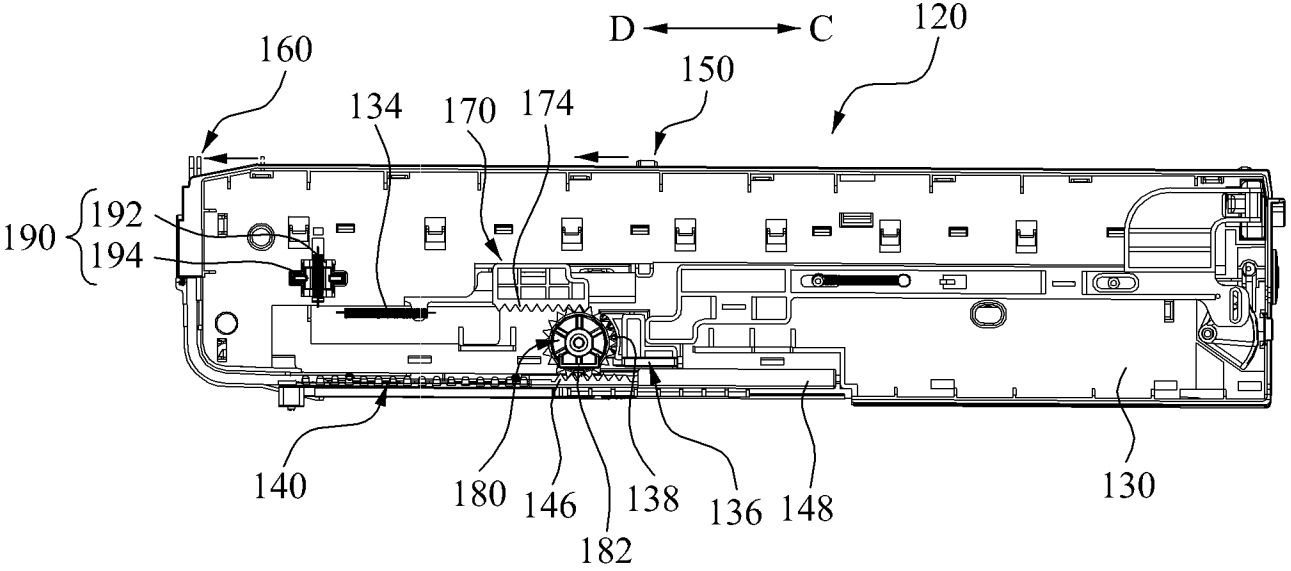
Figure 14:
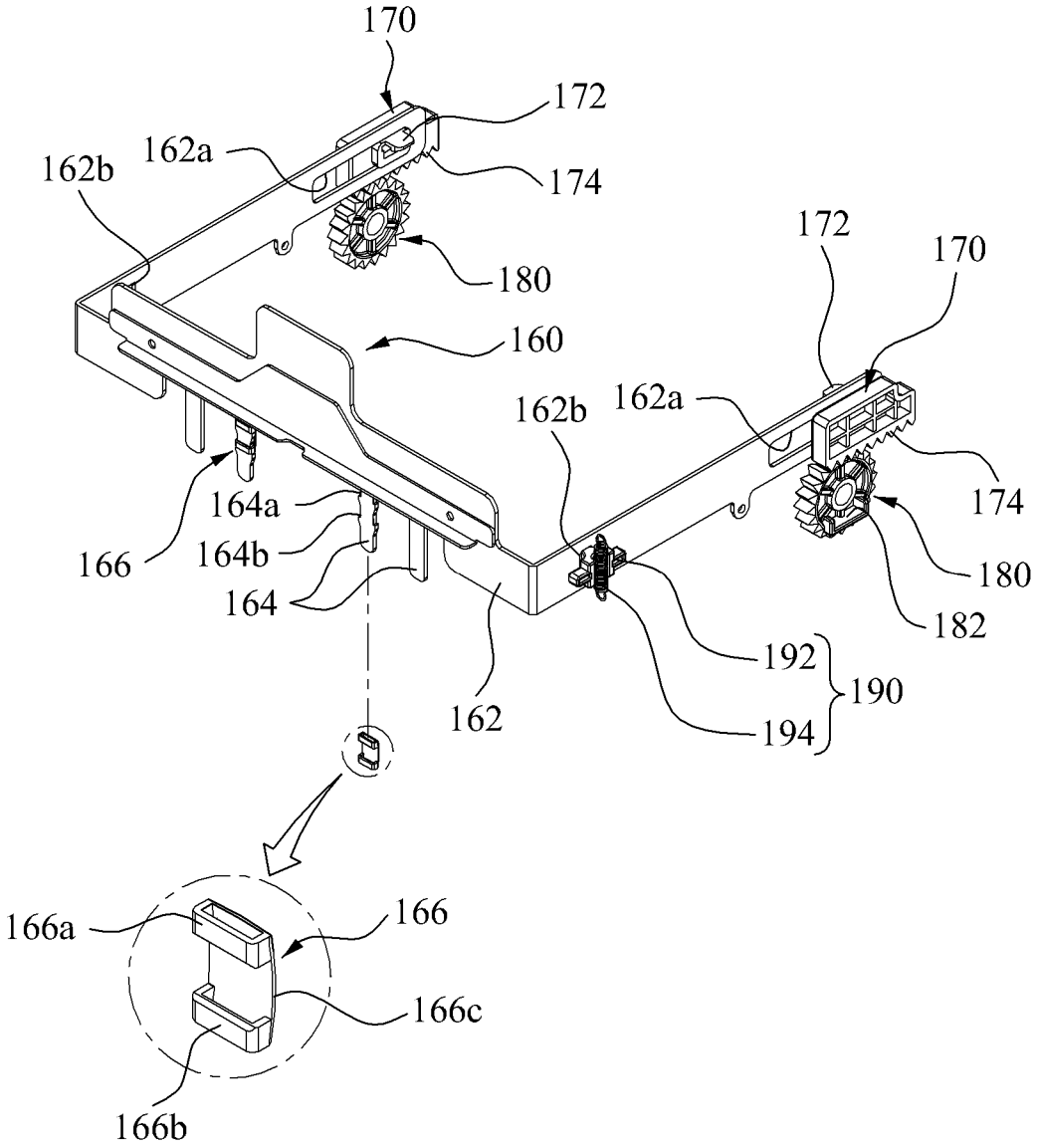
FIG. 14 is a perspective view illustrating main parts of the cassette shown in FIGS. 6 through 13.

As shown in FIGS. 12 and 13, the second medium support portion 160 may be moved in the second direction D and disposed at the entrance 132. The paper medium P in the cassette body 130 may also be disposed at the entrance 132, thereby contacting the pickup roller. When the pickup roller is driven, the pickup roller may pick up the paper medium P in the cassette body 130 sheet by sheet and feed the paper medium P to the transfer portion 111 through the entrance 132.

However, when the cassette 120 is separated from the cassette receiving portion 122 of the ATM 100, the shutter 140 may be relatively moved by the shutter operation lever 124 and the shutter stoppers 142 and 144 in the direction for closing the entrance 132.

In FIGS. 6 to 13, operational directions of the shutter 140, the medium return gear portion 180, the connection portion 170, and the second portion 160 of when the cassette 120 is separated are indicated by dotted-line arrows.

As shown in FIGS. 12 and 13, when the shutter 140 is moved in the direction for closing the entrance 132, the linear moving force of the shutter 140 may be transmitted to the medium return gear portion 180 through the shutter gear 146 and converted into the rotational force of the medium return gear portion 180. In addition, the rotational force of the medium return gear portion 180 may be converted into the linear moving force of the connection portion 170 through the connection portion gear 174. Accordingly, the connection portion 170 may be linearly moved by the predetermined length corresponding to the length of the shutter gear 146 in the first direction C.

Comparing the connection process and the separation process of the cassette 120, the movement directions of the shutter 140, the connection portion 170, and the second medium support portion 160 are opposite. Also, the rotational directions of the medium return gear portion 180 are opposite.

Figure 7:
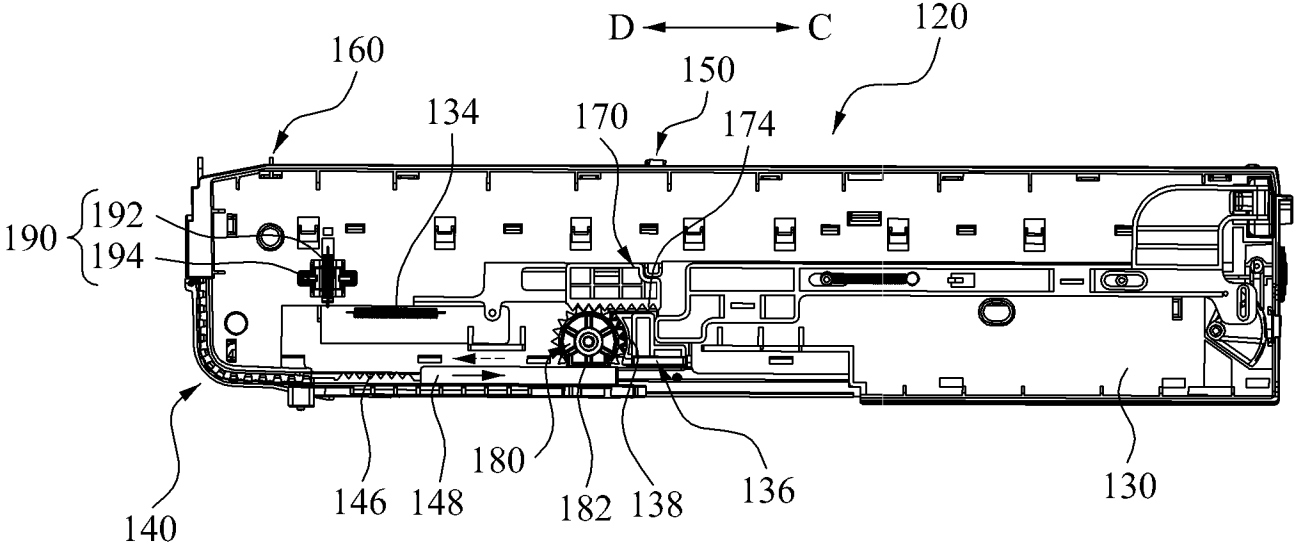

As aforementioned, when the second medium support portion 160 is moved in the first direction C along with the connection portion 170, the second medium support portion 160 is separated away from the entrance 132 as shown in FIGS. 8 and 7. Therefore, the paper medium P disposed at the entrance 132 may return into the cassette body 130.

When the second medium support portion 160 and the connection portion 170 are moved by the predetermined distance corresponding to the length of the shutter gear 146 in the first direction C, the locking portion 190 may be caught in the locking holes 162*b* and connection between the medium return gear portion 180 and the shutter gear 146 is released. In addition, the first stopper 148 of the medium return gear portion 180 is brought into contact with the second stopper 182 of the shutter 140. Therefore, the second medium support portion 160 and the connection portion 170 are maintained in a state of being moved by the predetermined distance in the first direction C. In addition, the medium return gear portion 180 is maintained in a state of being restricted from rotating by the first stopper 148 and the second stopper 182.

Figure 6:
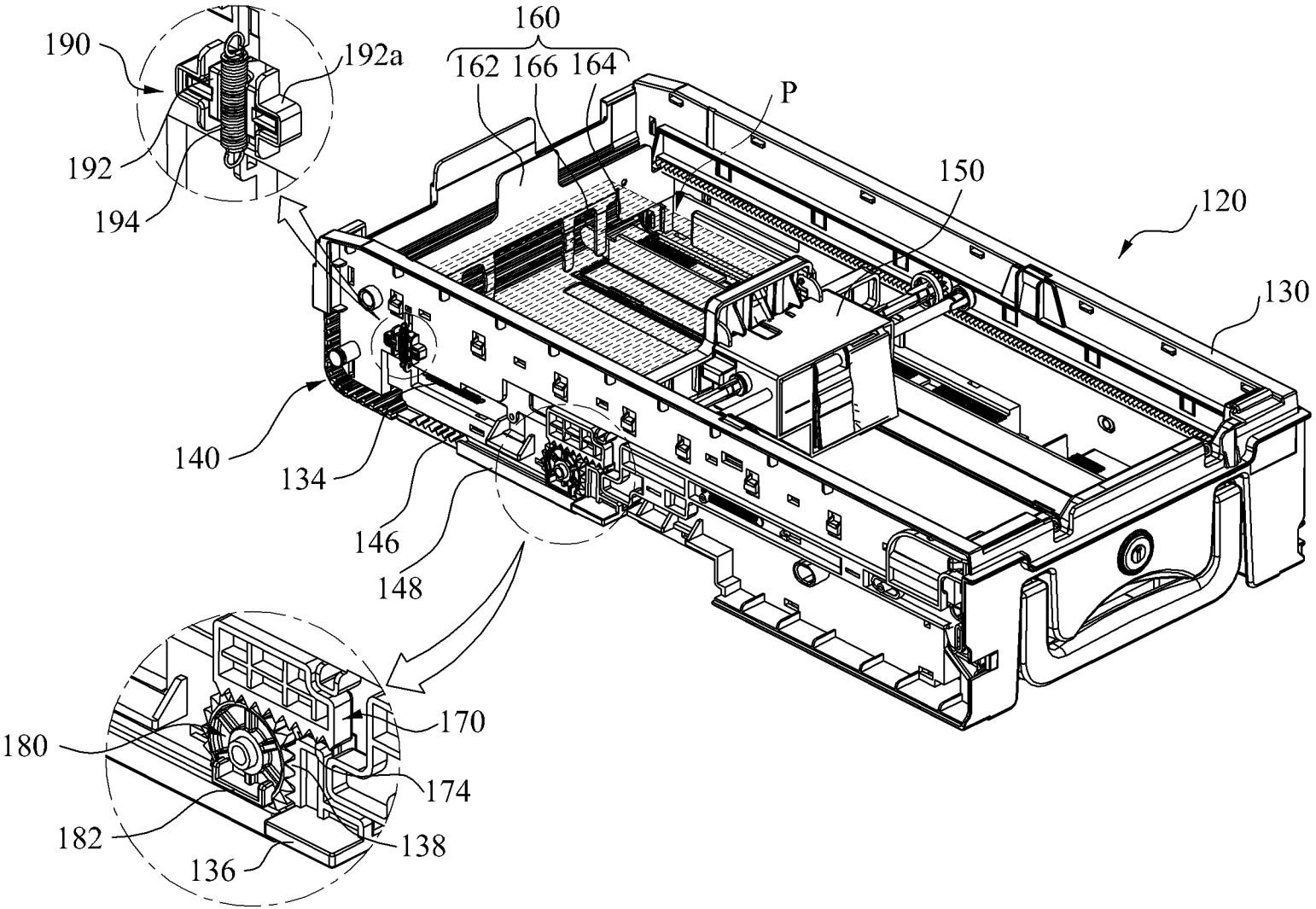
FIGS. 6 through 13 are state views illustrating operation of a second medium support portion, a connection portion, and a medium return gear portion during connection and separation of a cassette, according to an embodiment of the present invention.

As shown in FIGS. 6 and 7, when the cassette 120 is separated from the cassette receiving portion 122, the shutter 140 is continuously moved in the direction for closing the entrance 132, and the pressed portion 136 is moved to the position not interfered with the interference portion 126, thereby returning to the initial position. Accordingly, the pressed portion gear 138 of the pressed portion 136 may be connected with the medium return gear portion 180, thereby completely restricting rotation of the medium return gear portion 180. Next, separation of the cassette 120 may be completed with the entrance 132 of the cassette body 130 fully closed by the shutter 140.

Although a few embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents.

Industrial Applicability

The present invention relates to a cassette used for an automatic teller machine (ATM). The cassette may be applied to any types of ATM in which the cassette is connected and separated to receive or dispense a paper medium such as banknotes, merchandise coupons, and the like.

The invention claimed is:

1. A cassette for an automatic teller machine (ATM), removably connected to a cassette receiving portion placed at a main body of the ATM, the cassette comprising:

a cassette body connected and separated with respect to the cassette receiving portion and configured to receive a paper medium, including an entrance disposed at one side for entry of the paper medium;

a movable shutter placed at the cassette body to open and close the entrance according to connection and separation of the cassette body with respect to the cassette receiving portion;

a movable first medium support portion placed in the cassette body to push the paper medium toward the entrance;

a movable second medium support portion movably placed at the entrance so that the paper medium is disposed between the first medium support portion and the second medium support portion;

a movable connection portion connected to each of opposite ends of the second medium support portion and placed at opposite lateral sides of the cassette body; and a rotatable medium return gear portion placed at each of the opposite lateral sides of the cassette body so as to be connected to a connection portion gear connected to the connection portion and to a shutter gear placed at the shutter, the medium return gear portion configured to forcibly move the connection portion in a first direction away from the entrance by a moving force of the shutter when the entrance is closed.

2. The cassette of claim 1, wherein the opposite ends of the second medium support portion comprises connection holes or connection grooves in which connection projections placed at the movable connection portion are inserted, the connection holes or the connection grooves extend in a movement direction of the second medium support portion to be longer than a movement distance of the second medium support portion, and the second medium support portion and the cassette body comprise a return spring to provide an elastic force in a second direction toward an initial position of the second medium support portion.

3. The cassette of claim 2, further comprising a locking portion disposed at each of the opposite lateral sides of the cassette body, respectively, to restrict movement of the second medium support portion until the first medium support portion is operated when the connection portion is moved in the second direction.

4. The cassette of claim 3, wherein the opposite ends of the second medium support portion comprise a locking hole or locking recess, and the locking portion comprises:

a movably locking projection at the cassette body to be inserted in the locking hole or locking recess when the second medium support portion is moved in the first direction and separated from the locking hole or locking recess when the second medium support portion is moved in the second direction; and an elastic member disposed between the locking projection and the cassette body to elastically support the locking projection.

5. The cassette of claim 2, wherein the shutter gear is extended by a predetermined length at each of the opposite lateral sides of the shutter to move the connection portion by a predetermined distance in the first direction at the beginning of closing the entrance or to move the connection portion by a predetermined distance in the second direction right before the entrance is fully opened.

6. The cassette of claim 5, wherein the shutter comprises a first stopper disposed at each opposite sides to the opposite lateral sides of the shutter and extended in a movement direction of the shutter, and the medium return gear portion comprises a second stopper disposed at one side of the medium return gear portion to be brought into contact with the first stopper in a sliding manner so as to restrict rotation of the medium return gear portion when the shutter gear and the medium return gear portion are not connected.

7. The cassette of claim 1, wherein the opposite lateral sides of the cassette body each comprise a pressed portion pressed by a predetermined depth by interference with an interference portion formed at the cassette receiving portion when the cassette is connected, the pressed portion comprises a pressed portion gear disposed at one side of the pressed portion to restrict rotation of the medium return gear portion through connection with the medium return gear portion, and connection between the medium return gear portion and the pressed portion gear is released when the pressed portion is pressed by the predetermined depth.

8. The cassette of claim 7, wherein the pressed portion is interfered with the interference portion before the medium return gear portion and the shutter gear are connected when the cassette is connected, and interference between the pressed portion and the interference portion is released after the medium return gear portion and the shutter gear are connected when the cassette is separated.

9. The cassette of claim 1, wherein the second medium support portion comprises:

a movable support portion body disposed in the cassette body, opposite ends of which are extended along the opposite lateral sides of the cassette body;

a plurality of support projections protruded from the support portion body toward the entrance and brought into contact with the paper medium when the connection portion is returned in the first direction; and a removable rubber pad connected by enclosing an outer circumference of the support projections to increase a contact force between the support projections and the paper medium.

10. The cassette of claim 9, wherein the rubber pad comprises:

an upper fitting portion of a ring shape to be fit with an upper fixing recess formed at an upper portion of each of the support projection;

a lower fitting portion of a ring shape to be fit with a lower fixing recess of each of the support projections; and a contact portion connected to the upper fitting portion and the lower fitting portion and disposed at a contact surface of the support projections contacting the paper medium.

* * * * *